US008801531B2

(12) United States Patent
Buchanan et al.

(10) Patent No.: US 8,801,531 B2
(45) Date of Patent: Aug. 12, 2014

(54) GOLF GRIP TRAINING AID

(71) Applicants: Pete Buchanan, Manchester, MO (US); Charles Rowdy Jones, Manchester, MO (US)

(72) Inventors: Pete Buchanan, Manchester, MO (US); Charles Rowdy Jones, Manchester, MO (US)

( * ) Notice: Subject to any disclaimer, the term of this patent is extended or adjusted under 35 U.S.C. 154(b) by 0 days.

(21) Appl. No.: 13/986,963

(22) Filed: Jun. 18, 2013

(65) Prior Publication Data

US 2013/0337927 A1 Dec. 19, 2013

Related U.S. Application Data

(60) Provisional application No. 61/690,095, filed on Jun. 19, 2012.

(51) Int. Cl.

| | |
|---|---|
| ***A63B 69/36*** | (2006.01) |
| ***A41D 13/00*** | (2006.01) |
| ***A61F 5/00*** | (2006.01) |

(52) U.S. Cl.

USPC ..... 473/213; 473/207; 2/16; 602/5; 602/21

(58) Field of Classification Search

USPC ..... 473/62, 207, 212, 213, 214; 2/16, 20, 2/170; 602/5, 6, 21, 64

See application file for complete search history.

(56) References Cited

U.S. PATENT DOCUMENTS

| | | | | |
|---|---|---|---|---|
| 802,623 | A | 10/1905 | Camp | |
| 1,469,315 | A * | 10/1923 | Hansard | 473/213 |
| 2,794,638 | A | 6/1957 | Risher et al. | |
| 2,924,458 | A | 2/1960 | Barry | |
| 2,947,307 | A | 8/1960 | Hoppe | |
| 3,048,169 | A | 8/1962 | Pierce | |
| 3,217,332 | A | 11/1965 | Gross | |
| 3,339,926 | A | 9/1967 | Coupar | |
| 3,423,095 | A | 1/1969 | Cox | |
| 3,700,245 | A | 10/1972 | Nannini | |
| D234,434 | S | 3/1975 | Trevino | |
| 3,906,943 | A | 9/1975 | Arluck | |
| 3,990,709 | A | 11/1976 | DeRogatis | |
| 4,138,108 | A * | 2/1979 | Robinson | 473/62 |
| 4,241,922 | A | 12/1980 | Elliott, Jr. | |
| 4,451,044 | A | 5/1984 | Elliott, Jr. | |
| 5,313,667 | A * | 5/1994 | Levine | 2/16 |
| 5,401,017 | A * | 3/1995 | McDonald et al. | 473/213 |
| 5,415,624 | A * | 5/1995 | Williams | 602/21 |
| 5,652,955 | A * | 8/1997 | Skewis | 2/20 |
| 5,728,059 | A * | 3/1998 | Wiesemann et al. | 602/64 |
| 5,759,166 | A * | 6/1998 | Nelson et al. | 602/21 |
| 6,261,252 | B1 * | 7/2001 | Darcey | 602/6 |
| 7,364,556 | B2 * | 4/2008 | Weaver, II | 602/5 |
| 7,708,709 | B2 * | 5/2010 | Brewer | 602/21 |

* cited by examiner

*Primary Examiner* — Nini Legesse

(74) *Attorney, Agent, or Firm* — Paul M. Denk

(57) ABSTRACT

This invention relates to a training aid (strategic Golf Grip and Swing Repeater Training Aid) to assist the golfer in performing the proper golf swing technique for the effective golf swing. This training aid will be placed on the leading wrist of the golfer to develop the proper swing technique and to create muscle memory and to allow for repeated practice for game improvement and consistency. It includes a cover with straps to wrap around the hand of the user, and incorporates a back hand plate to hold the hand and wrist in alignment and place during a golf swing. It may also incorporate a wrist plate.

13 Claims, 6 Drawing Sheets

GOLF GRIP TRAINING AID

CROSS REFERENCE TO RELATED APPLICATION

This non-provisional patent application claims priority to the provisional patent application having Ser. No. 61/690,095, filed on Jun. 19, 2012.

FIELD OF THE INVENTION

This invention relates generally to the sport of golf, particularly to provide proper positioning of the lead hand and wrist of the golf grip during the swing of a golf club. More specifically how by stabilizing the lead hand and wrist throughout the entire golf swing will create a more consistent golf swing resulting in the clubface returning to square at impact, producing straighter ball flight leading to consistently to more accurate and longer shots.

BACKGROUND OF THE INVENTION

This invention relates to a training aid (Effective Golf Grip and Swing Repeater Training Aid) to assist the golfer in maintaining and developing the proper positioning of the lead wrist and the angle formed between this wrist and the shaft of the club at address throughout the golf swing. This is a key component of the illustrated golf swing.

The golf swing was developed and uses a swing technique that keys on maintaining the wrist angle set at address thru the entire swing. This technique was developed to simplify the golf swing and make it more repeatable.

This angle is formed by the wrists and the shaft of the golf club when a golfer grips the club at address. By maintaining this angle, it allows the golfer to consistently return the golf club at impact in the same position it was at address, thus allowing for a square club face at impact. Golfers have continually struggled to achieve this address position at impact due to their wrists hinging during the swing. They in turn have to un-hinge during the swing to return to the address position. The timing of this un-hinging of the wrists back to impact is difficult to achieve and one of the main reasons golfers struggle to return the golf club square at impact and to hit consistent golf shots.

This invention was developed after years of watching golfers struggle to achieve the proper impact between the golf club and golf ball on a consistent basis. There are three impact elements necessary to hit a golf shot properly. The club face needs to arrive at impact square, the club path needs to swing thru the ball in the direction a player wants the ball to start and the club needs to swing level thru the ball at impact to have solid contact. These three elements of impact will produce straight solid golf shots. In developing this technique, it was determined that two of these impact factors would be easier to control on a consistent basis by maintaining the wrist angle between the wrists and the golf club at the address position. Golfers who hinge their wrists (flex and extend) or bend the wrists from ulnar and radial deviation during the golf swing, struggle to achieve consistent proper impact between the golf club and golf ball. Moving the wrists in any of these positions will cause the club face and the level of the club thru the ball to be difficult to achieve on a consistent basis.

From the proper swing set-up, maintaining the wrist/golf club angle throughout the entire golf swing technique will return the golf club square and level thru the ball at impact. This will produce straight solid shots. Once straight solid shots are achieved, it will be simple to then swing the club thru the ball in the direction the player wants the ball to start. This golf grip and swing repeater training aid will maintain the wrist angle at address throughout the entire swing. It will prevent the wrists from ulnar and radial deviation as well as flexing or extending. This will then allow the golfer to achieve consistent results and repetitive practice and muscle memory.

In particular, this invention discloses an improvement to the device disclosed in U.S. Pat. No. 4,451,044 issued May 29, 1984 and entitled Golf Training Aid, along with an additional device disclosed in U.S. Pat. No. 4,241,922 issued Dec. 30, 1980 and also entitled Golf Training Aid. Compared to the U.S. Pat. No. 4,451,044, this invention is intended for use with every golf club from the driver, hybrids, and irons on down to the putter. After many years of studying the golf grip and golf swing, this invention was designed to properly set the hand and wrist of the leading hand of the golf grip, stabilizing both the lead hand and second hand of the golf grip, allowing the clubface to remain square throughout the entire golf swing. With all the practicing that golfers do these days in order to try to improve their golf swing, many don't know if they are practicing the right way. The old saying: "practice makes perfect" is totally false. Practice does not make perfect. Practice makes permanent. If a golfer is practicing something the wrong way and continues to practice it the wrong way, he will never be successful in doing it the right way. There are many teaching methods out there however the plane simple golf swing teaching method is just that: simple. In the region of the elbow, stiff, throughout a golf swing.

The patent to J. D. Risher et al, U.S. Pat. No. 2,794,638, attempts to maintain some control of the wrist, to hold it fixed in one position during a golf swing.

The patent to G. D. Barry, U.S. Pat. No. 2,924,458, shows a support for use by the bowler, in order to maintain a bowling wrist during participation in that sport.

U.S. Pat. No. 2,947,307, shows a Plastic Foam Splint, but that device is for use for holding an injured limb stationary.

The patent to H. F. Pierce, U.S. Pat. No. 3,048,169, shows a Method of Forming Casts Made with Plastic Foam Material. This is also for use for medical purposes.

The patent to B. S. Gross, U.S. Pat. No. 3,217,332, shows a Sportsman's Accessory. It is a wrist-encircling device, and for use in providing assistance to the bowler.

The patent to R. B. Coupar, U.S. Pat. No. 3,339,926, shows a Golfer's Arm Bend Restraining Device. Once again, this device is designed for restraining the entire arm, to generally keep the lead arm straight, while driving the golf ball.

The patent to W. H. Cox, U.S. Pat. No. 3,423,095, shows another Golfing Aid, which attempts to keep the back of the lead hand from moving out of alignment, with the rest of the arm, during a golf swing.

The patent to Nannini, U.S. Pat. No. 3,700,245, shows another Golfer's Wrist Attachment, and this one is designed to accommodate a bend up of the wrist, apparently during an entire golf swing.

The patent to Arluck, U.S. Pat. No. 3,906,943, shows an Orthopedic Device, for keeping a limb apparently immobile, during rehabilitation.

Finally, the patent to DeRogatis, U.S. Pat. No. 3,990,709, shows a Golfer's Elbow Stiffener.

All of these prior art devices show various types of means for controlling some segment of the body, even when participating in golf, but none of these devices, it is submitted, can achieve the three impact factors and elements that can be attained from usage of the current development.

SUMMARY OF THE INVENTION

The golf swing device herein was developed and uses a swing technique that keys on maintaining the wrist angle set at address thru the entire swing. (Golf grip and swing repeater training aid will be placed on the left wrist for a right handed golfer and the right wrist for a left handed golfer—we will refer to this as the leading wrist) This angle is formed by the leading wrist and the shaft of the golf club when a golfer grips the club at address. By maintaining this angle, it allows the golfer to consistently return the golf club at impact in the same position it was at address. Golfers have continually struggled to achieve the address position at impact due to their wrists hinging during the swing. They in turn have to un-hinge during the swing to return to the address position. The timing of this un-hinging of the wrists back to impact is difficult to achieve and one of the main reasons golfers struggle to hit consistent golf shots.

The golf grip and swing repeater training aid will prevent the wrists from flexing or extending and prevents ulnar deviation and radial deviation. The four wrist directions: 1) Wrist Extension—backward movement of the hand going toward the outside of the forearm; 2) Wrist Radial Deviation—upward movement of the hand towards the top of the forearm; 3) Wrist Ulnar Deviation—downward movement of the hand towards the bottom of the forearm; 4) Wrist Flexion—inward movement of the hand going towards the inside of the forearm. Three adjustable straps allow for a proper fit and securely keep the golf grip and swing repeater training aid in place during the golf swing.

The golf grip and swing repeater training aid will maintain the angle of the leading wrist and the shaft of the golf club during the swing in the same angle they are at the address position.

The golf grip and swing repeater training aid will provide the assistance needed for repetitive practice. This training aid will be used for all of the areas of the golf game: full swing, pitching, chipping, bunker play and putting. Golfers will be able to practice repeating the proper swing technique which will bring them much needed consistency, muscle memory and lower golf scores.

It is therefore the principal object of this invention to maintain the angle formed of the leading wrist and the shaft of the golf club at the address position throughout the golf swing.

Still another object of the invention is to use this invention for all of the areas of the game of golf consisting of but not limited to putting, chipping, pitching, bunker shots and the full golf swing.

Yet another object of this invention is to provide repeated swings in practice and golf course play to enhance consistency and muscle memory for all of the shots of the golf game.

Still another object of the invention is to simplify the game of golf for all levels of golfers and to bring a more enjoyable golfing experience.

These and other objects may become more apparent upon review of the summary of the invention as provided herein, and upon undertaking a study of the description of its preferred embodiment, in view of the drawings.

DESCRIPTION OF THE PREFERRED EMBODIMENT

Figure 1:
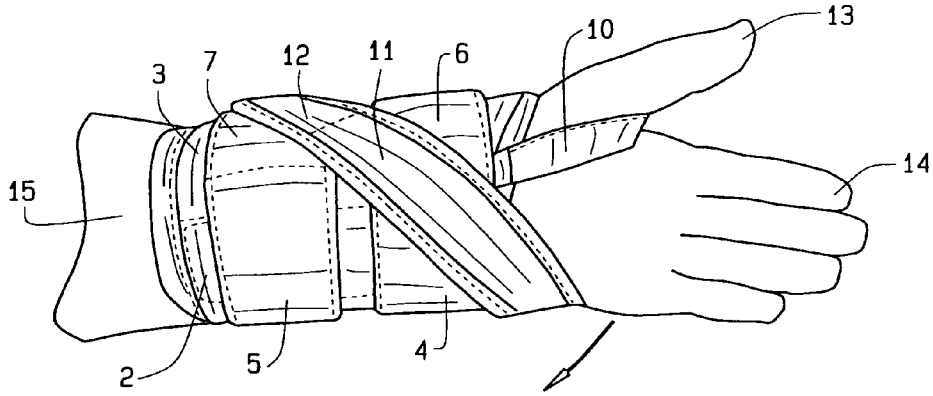
FIG. 1 is a view of the golf grip and swing repeater training aid on the left hand and wrist from the palm view. The arrow indicating the prevention of wrist ulnar deviation.

In reference to the drawings, referring to FIG. 1: this view shows the golf grip and swing repeater training aid on the left hand and wrist from the palm view. The arrow indicating the prevention of wrist ulnar deviation. This view is in relation to a right handed golfer. The golf grip and swing repeater training aid is fabricated from breathable cell foam covered with a layer of nylon and polyester Velcro material and incorporates Velcro ended straps to assist in securing the device to the wrist. 2 is the wrist plate made from plastic and is sewn into the fabric and assists in the prevention of wrist flexion 3 is the golf grip and swing repeater training aid itself. 4 is one of the straps fabricated from nylon and polyester material attached to the golf grip and swing repeater training aid for securing it to the wrist and 5 is a second strap fabricated from nylon and polyester material attached to the golf grip and swing repeater training aid for securing it to the wrist. 6 is the end portion of the strap 4 consisting of Velcro to fasten the strap 4 down to the golf grip and swing repeater training aid 3 itself. 7 is the end portion of the strap 5 consisting of Velcro to fasten the strap 5 down to the golf grip and swing repeater training aid 3 itself. 10 is an elastic fabric loop that the thumb goes thru to guide the golf grip and swing repeater training aid into the proper position and to assist in keeping it in place. 11 is a third strap fabricated from nylon and polyester material that is attached to the golf grip and swing repeater training aid and runs from the back of the wrist underneath the end of the wrist and forearm and attaches to the top of the golf grip and swing repeater training aid to assist in the prevention of wrist ulnar deviation. 12 is the end portion of the strap 11 consisting of Velcro to fasten the strap 11 down to the golf grip and swing repeater training aid 3 itself. 13 represents the thumb of the hand. 14 represents the forefinger of the hand. 15 represents the forearm.

Figure 2:
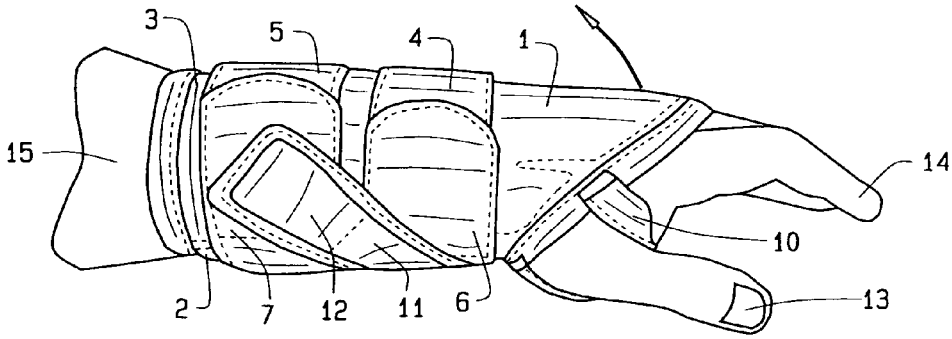
FIG. 2 is a view of the golf grip and swing repeater training aid on the left hand and wrist from the thumb side view with the wrist facing upwards. The arrow indicating the prevention of wrist extension.

FIG. 2: this view shows the golf grip and swing repeater training aid on the left hand and wrist from the thumb side view with the wrist facing upwards. The arrow indicating the prevention of wrist extension. This view is in relation to a right handed golfer. The golf grip and swing repeater training aid is fabricated from breathable cell foam covered with a layer of nylon and polyester Velcro material and incorporates Velcro ended straps to assist in securing the device to the wrist. 1 is the back hand plate made from plastic and is curved down on one side to go around the forearm and fit against the base of the thumb. It is sewn into the fabric and assists in the prevention of wrist extension and wrist radial deviation. 2 is the wrist plate made from plastic and is sewn into the fabric and assists in the prevention of wrist flexion. 3 is the golf grip and swing repeater training aid itself. 4 is one of the straps fabricated from nylon and polyester material attached to the golf grip and swing repeater training aid for securing it to the wrist. 5 is a second strap fabricated from nylon and polyester material attached to the golf grip and swing repeater training aid for securing it to the wrist. 6 is the end portion of the strap 4 consisting of Velcro to fasten the strap 4 down to the golf grip and swing repeater training aid 3 itself. 7 is the end portion of the strap 5 consisting of Velcro to fasten the strap 5 down to the golf grip and swing repeater training aid 3 itself. 10 is an elastic fabric loop that the thumb goes thru to guide the golf grip and swing repeater training aid into the proper position and to assist in keeping it in place. 11 is a third strap fabricated from nylon and polyester material that is attached to the golf grip and swing repeater training aid and runs from the back of the wrist underneath the end of the wrist and forearm and attaches to the top of the golf grip and swing repeater training aid to assist in the prevention of wrist ulnar deviation. 12 is the end portion of the strap 11 consisting of Velcro to fasten the strap 11 down to the training aid 3 itself. 13 represents the thumb of the hand. 14 represents the forefinger of the hand. 15 represents the forearm.

Figure 3:
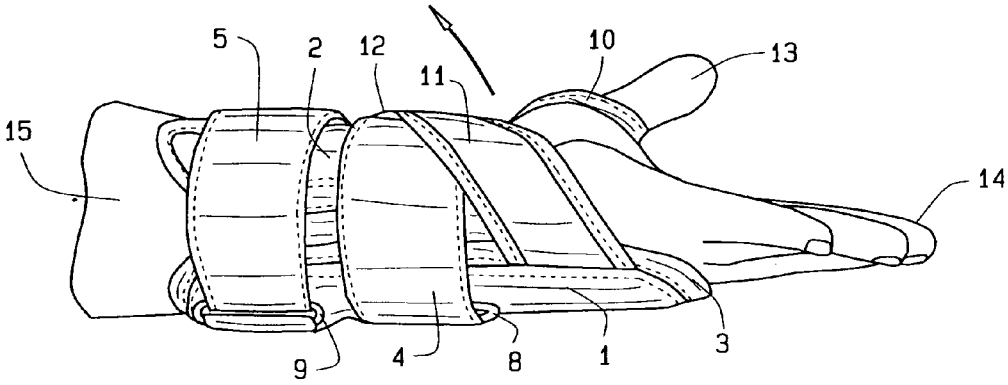
FIG. 3 is a view of the golf grip and swing repeater training aid on the left hand and wrist from the little finger palm up view. The arrow indicating the prevention of wrist flexion.

FIG. 3: this view shows the golf grip and swing repeater training aid on the left hand and wrist from the little finger palm up view. The arrow indicating the prevention of wrist flexion. This view is in relation to a right handed golfer. The golf grip and swing repeater training aid is fabricated from breathable cell foam covered with a layer of nylon and polyester Velcro material and incorporates Velcro ended straps to assist in securing the device to the wrist. 1 is the back hand plate made from plastic and is curved down on one side to go around the forearm and fit against the base of the thumb. It is sewn into the fabric and assists in the prevention of wrist extension and wrist radial deviation. 2 is the wrist plate made from plastic and is sewn into the fabric and assists in the prevention of wrist flexion. 3 is the golf grip and swing repeater training aid itself. 4 is one of the straps fabricated from nylon and polyester material attached to the golf grip and swing repeater training aid for securing it to the wrist. 5 is a second strap fabricated from nylon and polyester material attached to the golf grip and swing repeater training aid for securing it to the wrist. 8 is a plastic oval ring (metal can be used also) that is sewn in and attached to the golf grip and swing repeater training aid which strap 4 runs thru to assist in securing the strap 4 around the training aid for a secure fit to the wrist. 9 is a plastic oval ring (metal can be used also) that is sewn in and attached to the golf grip and swing repeater training aid which strap 5 runs thru to assist in securing the strap 5 around the training aid for a secure fit to the wrist. 10 is an elastic fabric loop that the thumb goes thru to guide the golf grip and swing repeater training aid into the proper position and to assist in keeping it in place. 11 is a third strap fabricated from nylon and polyester material that is attached to the golf grip and swing repeater training aid and runs from the back of the wrist underneath the end of the wrist and forearm and attaches to the top of the golf grip and swing repeater training aid to assist in the prevention of wrist ulnar deviation. 12 is the end portion of the strap 11 consisting of Velcro to fasten the strap 11 down to the golf grip and swing repeater training aid 3 itself. 13 represents the thumb of the hand. 14 represents the forefinger of the hand. 15 represents the forearm.

Figure 4:
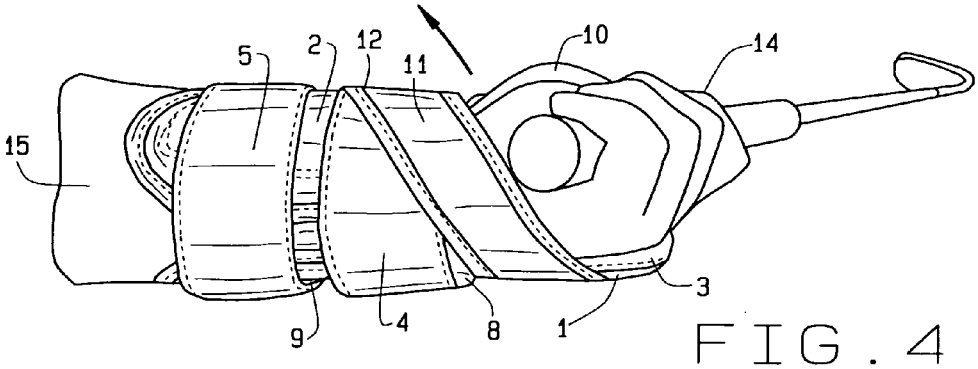
FIG. 4 is a view of the golf grip and swing repeater training aid on the left hand and wrist as seen gripping a golf club. The arrow indicating the prevention of wrist flexion.

FIG. 4: this view shows the golf grip and swing repeater training aid on the left hand and wrist as seen gripping a golf club. The arrow indicating the prevention of wrist flexion. This view is in relation to a right handed golfer. The golf grip and swing repeater training aid is fabricated from breathable cell foam covered with a layer of nylon and polyester Velcro material and incorporates Velcro ended straps to assist in securing the device to the wrist. 1 is the back hand plate made from plastic and is curved down on one side to go around the forearm and fit against the base of the thumb. It is sewn into the fabric and assists in the prevention of wrist extension and wrist radial deviation. 2 is the wrist plate made from plastic and is sewn into the fabric and assists in the prevention of wrist flexion 3 and is the golf grip and swing repeater training aid itself. 4 is one of the straps fabricated from nylon and polyester material attached to the golf grip and swing repeater training aid for securing it to the wrist. 5 is a second strap fabricated from nylon and polyester material attached to the golf grip and swing repeater training aid for securing it to the wrist. 8 is a plastic oval ring (metal can be used also) that is sewn in and attached to the golf grip and swing repeater training aid which strap 4 runs thru to assist in securing the strap 4 around the training aid for a secure fit to the wrist. 9 is a plastic oval ring (metal can be used also) that is sewn in and attached to the golf grip and swing repeater training aid which strap 5 runs thru to assist in securing the strap 5 around the golf grip and swing repeater training aid for a secure fit to the wrist. 10 is an elastic fabric loop that the thumb goes thru to guide the golf grip and swing repeater training aid into the proper position and to assist in keeping it in place. 11 is a third strap fabricated from nylon and polyester material that is attached to the golf grip and swing repeater training aid and runs from the back of the wrist underneath the end of the wrist and forearm and attaches to the top of the golf grip and swing repeater training aid to assist in the prevention of wrist ulnar deviation. 12 is the end portion of the strap 11 consisting of Velcro to fasten the strap 11 down to the golf grip and swing repeater training aid 3 itself. 14 represents the forefinger of the hand. 15 represents the forearm.

Figure 5:
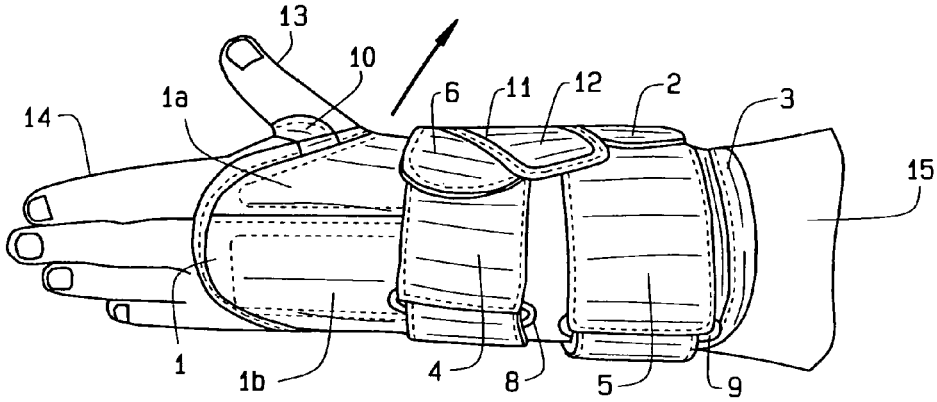
FIG. 5 is a view of the golf grip and swing repeater training aid on the left hand and wrist from the thumb up with the back of the wrist view. The arrow indicating the prevention of wrist radial deviation.

FIG. 5: this view shows the golf grip and swing repeater training aid on the left hand and wrist from the thumb up with the back of the wrist view. The arrow indicating the prevention of wrist radial deviation. This view is in relation to a right handed golfer. The golf grip and swing repeater training aid is fabricated from breathable cell foam covered with a layer of nylon and polyester Velcro material and incorporates Velcro ended straps to assist in securing the device to the wrist. 1 is the back hand plate made from plastic and is curved down on one side to go around the forearm and fit against the base of the thumb. It is sewn into the fabric and assists in the prevention of wrist extension and wrist radial deviation. 3 is the golf grip and swing repeater training aid itself. 4 is one of the straps fabricated from nylon and polyester material attached to the golf grip and swing repeater training aid for securing the plane simple golf grip and swing repeater training aid to the wrist. 5 is a second strap fabricated from nylon and polyester material attached to the plane simple golf grip and swing repeater training aid for securing the golf grip and swing repeater training aid to the Wrist. 6 is the end portion of the strap 4 consisting of Velcro to fasten the strap 4 down to the golf grip and swing repeater training aid 3 itself. 7 is the end portion of the strap 5 consisting of Velcro to fasten the strap 5 down to the golf grip and swing repeater training aid 3 itself. 8 is a plastic oval ring (metal can be used also) that is sewn in and attached to the golf grip and swing repeater training aid which strap 4 runs thru to assist in securing the strap 4 around the training aid for a secure fit to the Wrist. 9 is a plastic oval ring (metal can be used also) that is sewn in and attached to the golf grip and swing repeater training aid which strap 5 runs thru to assist in securing the strap 5 around the golf grip and swing repeater training aid for a secure fit to the wrist. 10 is an elastic fabric loop that the thumb goes thru to guide the training aid into the proper position and to assist in keeping it in place. 11 is a third strap fabricated from nylon and polyester material that is attached to the golf grip and swing repeater training aid and runs from the back of the wrist underneath the end of the wrist and forearm and attaches to the top of the golf grip and swing repeater training aid to assist in the prevention of wrist ulnar deviation. 12 is the end portion of the strap 11 consisting of Velcro to fasten the strap 11 down to the golf grip and swing repeater training aid 3 itself. 13 represents the thumb of the hand. 14 represents the forefinger of the hand. 15 represents the forearm.

Figure 6:
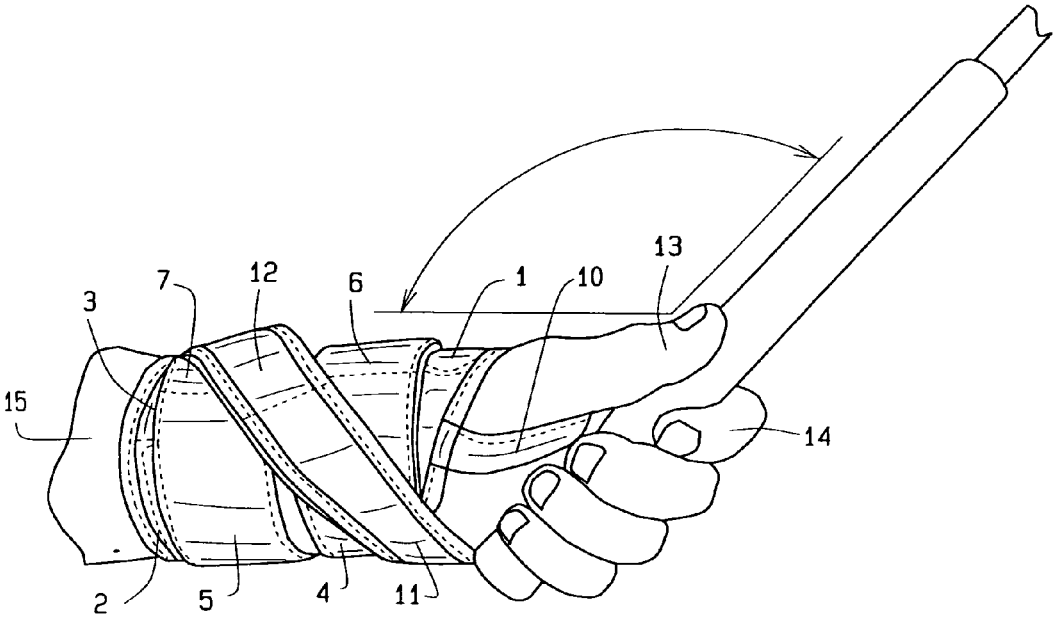
FIG. 6 is a view of the golf grip and swing repeater training aid on the left hand (lead hand for a right hand golfer) and wrist while gripping a golf club. The arrow indicating the angle formed between the left wrist and the shaft of the golf club.

FIG. 6: this view shows the golf grip and swing repeater training aid on the left hand and wrist from the palm view while gripping a golf club. The arrow indicating the angle formed between the left wrist and the shaft of the golf club. This view is in relation to a right handed golfer. The golf grip and swing repeater training aid is fabricated from breathable cell foam covered with a layer of nylon and polyester Velcro material and incorporates Velcro ended straps to assist in securing the device to the wrist. 1 is the back hand plate made from plastic and is curved down on one side to go around the forearm and fit against the base of the thumb. It is sewn into the fabric and assists in the prevention of wrist extension and wrist radial deviation. 2 is the wrist plate made from plastic and is sewn into the fabric and assists in the prevention of wrist flexion. 3 is the golf grip and swing repeater training aid itself. 4 is one of the straps fabricated from nylon and polyester material attached to the golf grip and swing repeater training aid for securing the golf grip and swing repeater training aid to the wrist. 5 is a second strap fabricated from nylon and polyester material attached to the golf grip and swing repeater training aid for securing the golf grip and swing repeater Training aid to the wrist. 6 is the end portion of the strap 4 consisting of Velcro to fasten the strap 4 down to the golf grip and swing repeater training aid 3 itself. 7 is the end portion of the strap 5 consisting of Velcro to fasten the strap 5 down to the golf grip and swing repeater training aid 3 itself. 10 is an elastic fabric loop that the thumb goes thru to guide the training aid into the proper position and to assist in keeping it in place. 11 is a third strap fabricated from nylon and polyester material that is attached to the golf grip and swing repeater training aid and runs from the back of the wrist underneath the end of the wrist and forearm and attaches to the top of the golf grip and swing repeater training aid to assist in the prevention of wrist ulnar deviation. 12 is the end portion of the strap 11 consisting of Velcro to fasten the strap 11 down to the golf grip and swing repeater training aid 3 itself. 13 represents the thumb of the hand. 14 represents the forefinger of the hand. 15 represents the forearm.

Figure 7:
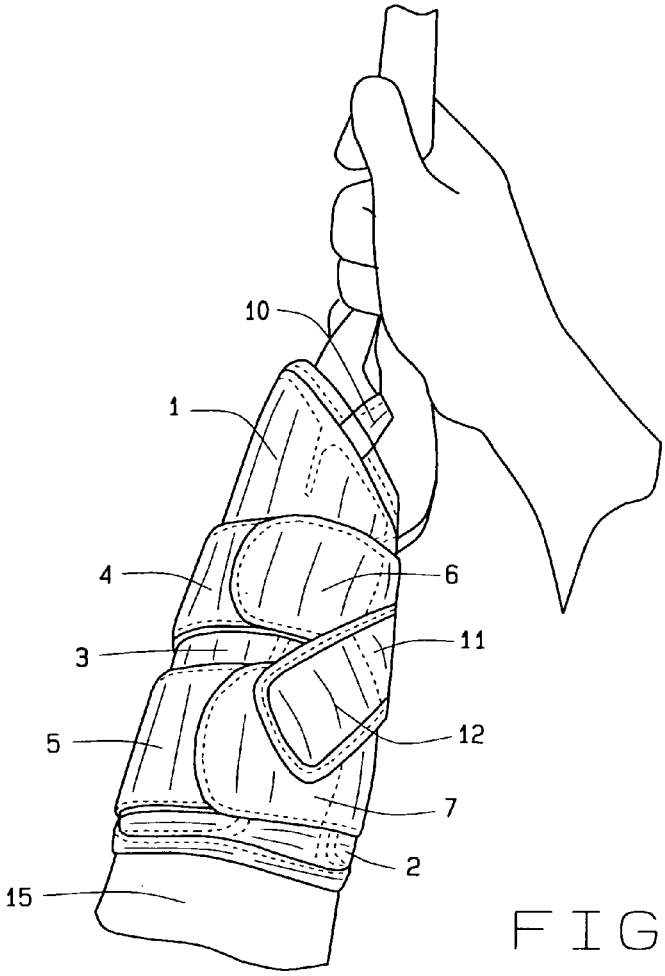
FIG. 7 is a view of the golf grip and swing repeater training aid on the left hand and wrist showing both hands on the grip of a golf club.

FIG. 7: this view shows the golf grip and swing repeater training aid on the left hand and wrist showing both hands on the grip of a golf club. This view is in relation to a right handed golfer. The golf grip and swing repeater training aid is fabricated from breathable cell foam covered with a layer of nylon and polyester Velcro material and incorporates Velcro ended straps to assist in securing the device to the wrist. 1 is the back hand plate made from plastic and is curved down on one side to go around the forearm and fit against the base of the thumb. It is sewn into the fabric and assists in the prevention of wrist extension and wrist radial deviation. 2 is the wrist plate made from plastic and is sewn into the fabric and assists in the prevention of wrist flexion. 3 is the golf grip and swing repeater training aid itself. 4 is one of the straps fabricated from nylon and polyester material attached to the training aid (repeater) for securing the golf grip and swing repeater training aid to the wrist. 5 is a second strap fabricated from nylon and polyester material attached to the golf grip and swing repeater training aid for securing the training aid (repeater) to the wrist. 6 is the end portion of the strap 4 consisting of Velcro to fasten the strap 4 down to the golf grip and swing repeater training aid 3 itself. 7 is the end portion of the strap 5 consisting of Velcro to fasten the strap 5 down to the plane simple golf grip and swing repeater training aid 3 itself. 10 is an elastic fabric loop that the thumb goes thru to guide the training aid into the proper position and to assist in keeping it in place. 11 is a third strap fabricated from nylon and polyester material that is attached to the plane simple golf grip and swing repeater training aid and runs from the back of the wrist underneath the end of the wrist and forearm and attaches to the top of the golf grip and swing repeater training aid to assist in the prevention of wrist ulnar deviation. 12 is the end portion of the strap 11 consisting of Velcro to fasten the strap 11 down to the golf grip and swing repeater training aid 3 itself. 15 represents the forearm.

Figure 8:
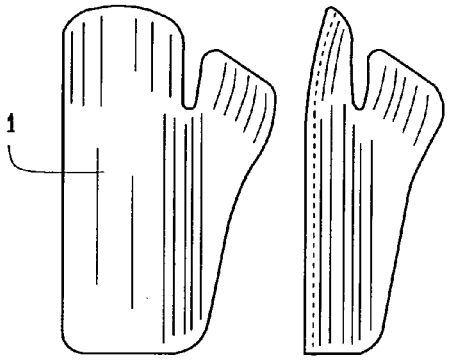
FIG. 8 is a view of the back of hand plate.

FIG. 8: this is a view (front, right and top) of the back of hand plate 1. The back of hand plate is made from plastic material and is curved down on one side to go around the forearm and fit against the base of the thumb. It is sewn into the fabric and assists in the prevention of wrist extension and wrist radial deviation.

Figure 9:
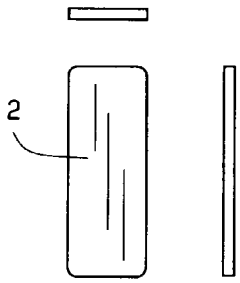
FIG. 9 is a view of the inside wrist plate.

FIG. 9: this is a view (front, right and top) of the inside wrist plate 2. The wrist plate is made from plastic material and is sewn into the fabric and assists in the prevention of wrist flexion.

Figure 10:
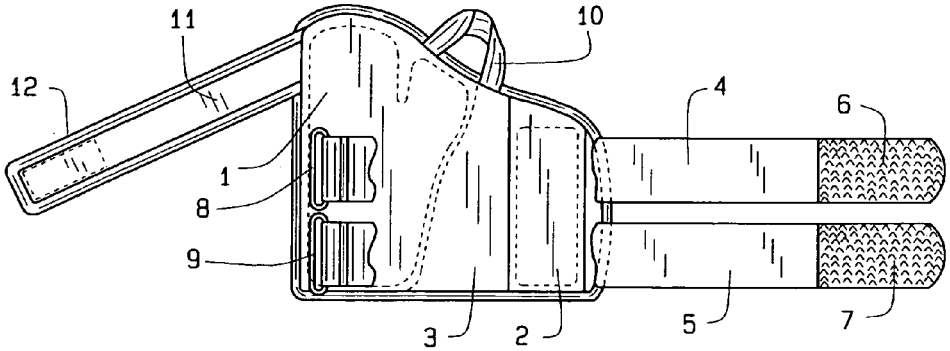
FIG. 10 is a view of the outside of the golf grip and swing repeater training aid.

FIG. 10: this is a view of the outside of the golf grip and swing repeater training aid this view is in relation to a right handed golfer. The training aid is fabricated from nylon and polyester material and incorporates Velcro ended straps to assist in securing the device to the wrist. 1 is the back hand plate made from plastic and is curved down on one side to go around the forearm and fit against the base of the thumb. It is sewn into the fabric and assists in the prevention of wrist extension and wrist radial deviation. 2 is the wrist plate made from plastic and is sewn into the fabric and assists in the prevention of wrist flexion 3 is the golf grip and swing repeater training aid itself. 4 is one of the straps fabricated from nylon and polyester material attached to the golf grip and swing repeater training aid for securing the golf grip and swing repeater training aid to the wrist 5 is a second strap fabricated from nylon and polyester material attached to the golf grip and swing repeater training aid for securing the golf grip and swing repeater training aid to the wrist. 6 is the end portion of the strap 4 consisting of Velcro to fasten the strap 4 down to the golf grip and swing repeater training aid 3 itself. 7 is the end portion of the strap 5 consisting of Velcro to fasten the strap 5 down to the golf grip and swing repeater training aid 3 itself. 8 is a plastic oval ring (metal can be used also) that is sewn in and attached to the golf grip and swing repeater training aid which strap 4 runs thru to assist in securing the strap 4 around the training aid for a secure fit to the wrist. 9 is a plastic oval ring (metal can be used also) that is sewn in and attached to the golf grip and swing repeater training aid which strap 5 runs thru to assist in securing the strap 5 around the training aid for a secure fit to the wrist. 10 is an elastic fabric loop that the thumb goes thru to guide the training aid into the proper position and to assist in keeping it in place. 11 is a third strap fabricated from nylon and polyester material that is attached to the golf grip and swing repeater training aid and runs from the back of the wrist underneath the end of the wrist and forearm and attaches to the top of the golf grip and swing repeater training aid to assist in the prevention of wrist ulnar deviation. 12 is the end portion of the strap 11 consisting of Velcro to fasten the strap 11 down to the golf grip and swing repeater training aid 3 itself.

Figure 11:
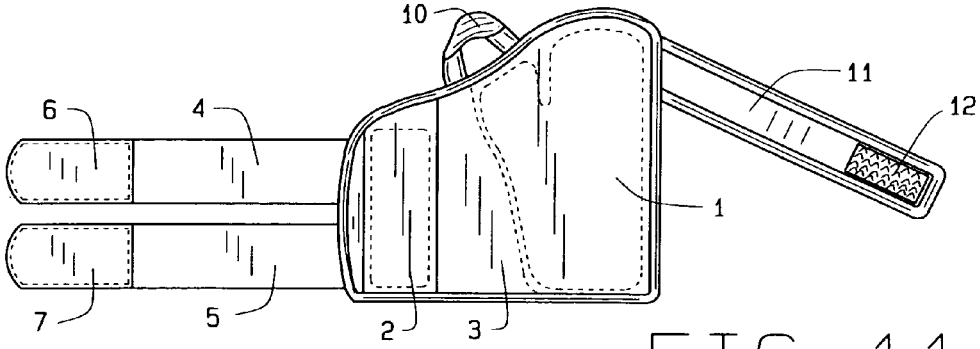
FIG. 11 is a view of the inside of the golf grip and swing repeater training aid.

FIG. 11: this is a view of the inside of the golf grip and swing repeater training aid this view is in relation to a right handed golfer. The golf grip and swing repeater training aid is fabricated from breathable cell foam covered with a layer of nylon and polyester Velcro material and incorporates Velcro ended straps to assist in securing the device to the wrist. 1 is the back hand plate made from plastic and is curved down on one side to go around the forearm and fit against the base of the thumb. It is sewn into the fabric and assists in the prevention of wrist extension and wrist radial deviation. 2 is the wrist plate made from plastic and is sewn into the fabric and assists in the prevention of wrist flexion 3 is the golf grip and swing repeater training aid itself. 4 is one of the straps fabricated from nylon and polyester material attached to the golf grip and swing repeater training aid for securing it to the wrist 5 is a second strap fabricated from nylon and polyester material attached to the golf grip and swing repeater training aid for securing it to the wrist. 6 is the end portion of the strap 4 consisting of Velcro to fasten the strap 4 down to the golf grip and swing repeater training aid 3 itself. 7 is the end portion of the strap 5 consisting of Velcro to fasten the strap 5 down to the golf grip and swing repeater training aid 3 itself. 10 is an elastic fabric loop that the thumb goes thru to guide the training aid into the proper position and to assist in keeping it in place. 11 is a third strap fabricated from nylon and polyester material that is attached to the golf grip and swing repeater training aid and runs from the back of the wrist underneath the end of the wrist and forearm and attaches to the top of the golf grip and swing repeater training aid to assist in the prevention of wrist ulnar deviation 12 is the end portion of the strap 11 consisting of Velcro to fasten the strap 11 down to the training aid 3 itself.

Figure 12:
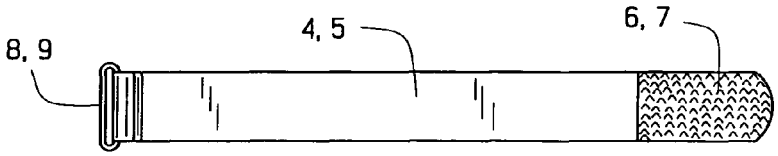
FIG. 12 is a view of one of the straps used in securing the golf grip and swing repeater training aid to the wrist.

FIG. 12: is a view of one of the straps 4 and 5 used in securing the golf grip and swing repeater training aid to the wrist. 4 is one of these straps fabricated from nylon and polyester material attached to the golf grip and swing repeater training aid with a Velcro end 6 for securing the golf grip and swing repeater training aid to the wrist 5 is a second strap fabricated from nylon and polyester material attached to the golf grip and swing repeater training aid with a Velcro end 7 for securing the golf grip and swing repeater training aid to the wrist. 8 is a plastic oval ring (metal can be used also) that is sewn in and attached to the golf grip and swing repeater training aid which strap 4 runs thru to assist in securing the strap 4 around the training aid for a secure fit to the wrist. 9 is a plastic oval ring (metal can be used also) that is sewn in and attached to the golf grip and swing repeater training aid which strap 5 runs thru to assist in securing the strap 5 around the golf grip and swing repeater training aid for a secure fit to the wrist.

Figure 13:
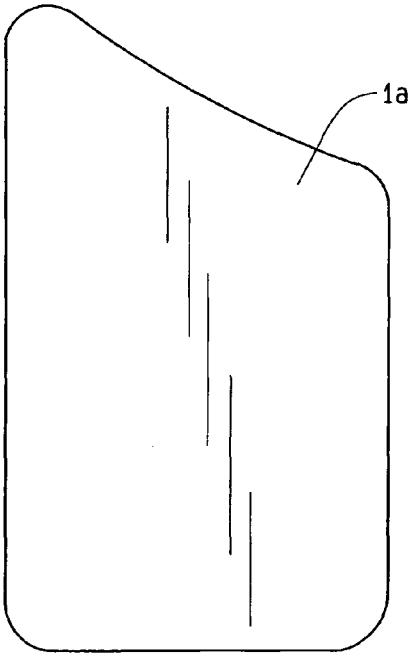
FIG. 13 shows a variation on the shape of the hand plate.
Figure 14:
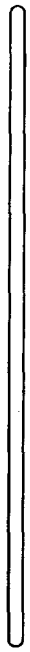
FIG. 14 is a variation on the shape of the hand plate.
Figure 15:
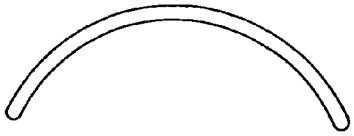
FIG. 15 is a variation on the shape of the hand plate.

A variation on the shape and design of the hand plate 1*a* is shown in FIGS. 13-15. This hand plate is designed for use as a substitute for the hand plate previously described in FIG. 8, and shown at its location within the training aid as explained in FIG. 10. As can be seen in FIG. 14, which is a left side view of the hand plate, it is of a thin line construction, and is generally made of a polymer, of a more hardened type of polymer, such as polypropylene, or any other polymer that has sufficient rigidity to act as a structural reinforcement to hold the various components of the golfer's hand, and grip, in place, during a swing. As can be seen in FIG. 15, the hand plate 1*a* has some degree of arcuateness to it, as at 1*b*, so that when it is in place upon the hand of the user, as disclosed in the variety of drawings previously provided and described in this application, the hand plate will embrace that segment of the hand in the vicinity and below the thumb 13, and extend down into the wrist area, as previously reviewed, and then extends slightly over the region of the left side of the palm, in order to prevent wrist extension, and wrist radial deviation, when the golfer undertakes the significant pressure involved in performing a golf swing, and at the same time, with this component, and the entire training aid to keep the player's wrist proper in alignment, so as to avoid the various deviations as previously explained, that do occur in man golfer's, regardless of their being of a beginning status, or even a somewhat experienced golfer.

Figure 16:
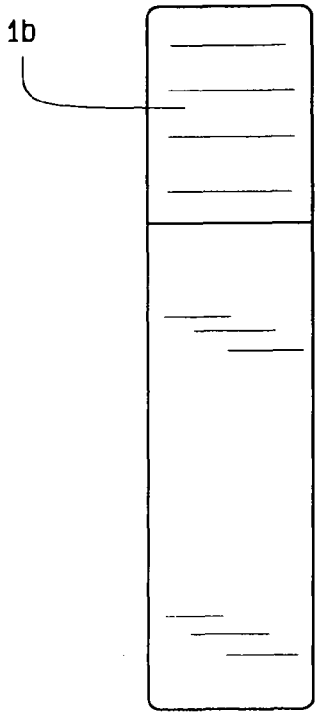
FIG. 16 is a front view of the back hand plate.
Figure 17:
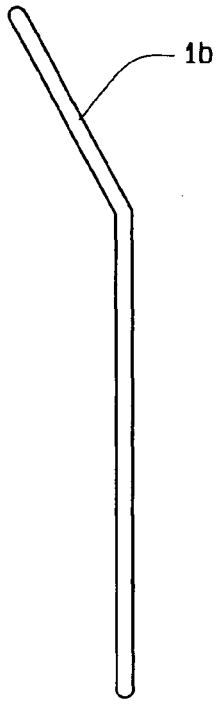
FIG. 17 is a side view thereof.
Figure 18:
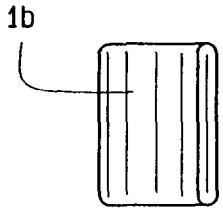
FIG. 18 is a bottom view thereof.

FIGS. 16-18 show what is identified as the back hand plate 1*b* of this invention. Essentially, it is a length of polymer, metal, or other rigid material, which has a bent upper end, as can be seen, and that particular back hand plate rest upon, obviously, that back of the hand of the user, upon installation. The back hand plate, at its location within the training aid, can be readily seen in FIG. 5, at reference character 1*b*. The plate locates within the training device, with its slightly bent upper end biasing against the upper part of the back of the hand. This also prevents the unauthorized movement of the hand, to control the type of deviations as explained on page 6 of the specification.

In this modified design, which provides for total control of the golf grip, through this training aid, generally includes all the various types of plates as identified herein. For example, the style of hand plate 1*a*, or 1, as noted within in the training aid, locates within the aid, and generally curves around the thumb edge of the hand and wrist, and has the shape and appearance as generally shown and described in FIGS. 13-15. Furthermore, the wrist plate 2 as can be seen embedded within the training aid, as noted in FIG. 10, generally locates against the lower part of the palm, just above the wrist, and then extends down into the region of the upper wrist, as located therebelow, in order to prevent flexion of the wrist at that location. Furthermore, that leaves the actual palm of the hand, arranged thereabove, for clear application and gripping of the handle of the golf club, so that the wrist plate 2 provides no interference with the grip and swing of the golf club, during usage of this training aid. Finally, the style of back hand plate 1*b*, as shown and described in FIGS. 16-18, can be seen in FIG. 5, resting against the back of the hand, and the upper part of the wrist, when located within the training aid. Each of the various plates as identified herein fit within their own little pouch or pocket contained within the training aid, primarily to keep them in proper position. Furthermore, the training aid itself is formed like a glove, having a more durable outer covering made of a heavy fabric, leather, polymer, or the like, to withstand repeated usage, while the inner layer may be of a softer type of material, for gripping purposes, and for comfort. Through the use of these three combinations of plates, the training aid can help reduce and eliminate movement of the four wrist deviations, prevents wrist extension, prevents wrist radial deviation, further prevents wrist ulnar deviation, and finally, reduces wrist flexion. This provides a complete training aid to help correct the swing of the golfer, while participating in this sport.

This is an example as to how this training aid, for the golfer, can be used to reduce those detriments that lead towards a poor drive or hit of the golf ball, and through the usage of this training aid, can substantially reduce if not eliminate those faults that lead to wrist extension, wrist radial deviation, wrist ulnar deviation, and wrist flexion.

Furthermore, while this invention has generally been described as a training aid for use by the right handed golfer, obviously, a mirror image of all of the components as previously shown, described, and explained, could be assembled into a training aid for use by the left handed golfer, and applied to his/her right hand, to provide the same benefits and enhancements to their golf swing, while participating in this popular sport.

Variations or modifications to the subject matter of this development may occur to those skilled in the art; upon review of the invention as provided herein. Such variations, if within the spirit of this invention, are intended to be encompassed within the scope of any claims to patent protection issuing herein. The description of the invention in the preferred embodiment, and as depicted in the drawings, are set forth for illustrative purposes only.

We claim:

1. A golf grip training aid in the form of a wrist wrap that consistently allows the golfer to return the golf club at impact to the same position it was when initially addressing the golf ball at the initiation of a drive or hit with an iron, a covering device provided for wrapping around the wrist and a portion of the hand, said covering device having first and second side edges, said covering device extending partially around the hand to generally provide coverage on the back of the hand, the thumb side edge of the hand, and a part of the wrist below the palm of the hand, loop means connecting with the upper end of the covering device and provided for looping around the thumb of the player's hand, at least one strap connecting with said first side edge of the covering device, and provided for retention of the wrist wrap wrapped around the wrist of the hand to secure it against removal during usage, a diagonal strap connecting with one of said first and second side edges of the covering device, and provided for wrapping around the applied wrist wrap of said training aid and including overlapping the at least one strap to completely secure the wrist wrap in place during usage, a wrist plate provided within the covering device proximate the location of the second side edge of the wrist wrap, in order to prevent downward wrist flexion during usage, and arcuate edge hand plate provided within the covering device proximately adjacent the location of the wrist plate, below the user's thumb, and arranged laterally from said wrist plate, and said arcuate hand plate provided for prevention of wrist extension and wrist radial deviation during usage of the training aid, a back hand plate provided within the covering device and arranged adjacent to the arcuate hand plate, and proximate the first side edge of said covering device, said back hand plate provided for overlying the back of the hand and the upper portion of the wrist of the wearer, and said back hand plate provided for preventing the wearer's hand from flexing upwardly during usage of the training aid, wherein during usage of the training aid, the training aid applied on the wrist of the golfer during usage returns the golf club at impact into the same position as the golf ball was addressed before the golf swing.

2. The golf grip training aid of claim 1 wherein there are a pair of straps extending from the wrist wrap which wrap the training aid into position during usage.

3. The golf grip training aid of claim 1 wherein said wrist plate, arcuate hand plate and back hand plate are made of rigid polymer.

4. The golf grip training aid of claim 1 wherein said back hand plate has a portion that overlies the back of the hand and upper portion of the wrist, and an integral second portion maintained at an angular relationship to the upper portion of the back hand plate which contains the thumb in alignment with hand and with the wrist during its usage.

5. The golf grip training aid of claim 1 wherein said covering device includes a covering of cloth and a foamed liner contained therein.

6. The golf grip training aid of claim 1 wherein said arcuate hand plate is of arcuate shape along its length.

7. The golf grip training aid of claim 6 wherein said arcuate hand plate has a portion that overlies the side edge of the hand at a region below the users thumb, and overlies at a region in the upper portion of the wrist, and has a part that maintains a straight relationship to contain the users thumb in alignment with the hand and the leading edge of the wrist during its usage.

8. A golf grip training aid that consistently allows the golfer to return the golf club at impact to the same position it was when initially addressing the golf ball at the initiation of a drive or hit with an iron, a covering device provided for wrapping around the wrist and portions of the hand, said covering device having first and second side edges, said covering device extending around the hand to generally provide coverage on the back, the thumb edge, and below the palm of the hand during usage, loop means connecting with the upper thumb edge of the covering device and provided for looping around the thumb of the player's hand, at least one strap connecting with a first side edge of the covering device, and provided for retention of the covering device wrapped around the wrist and hand of the player to secure it against removal during usage, a diagonal strap connecting with one of said first and second side edges of the covering device and provided for wrapping around the applied training aid including over the one strap to completely secure the wrist wrap in place during usage, a wrist plate provided within the covering device proximate the location of the second edge of the covering device, said wrist plate provided for generally overlying the lower edge of the palm and the upper wrist of the hand in order to prevent the upward movement of the hand relative to the wrist during usage of said training aid, a hand plate provided within the covering device and provided for overlying the edge of the hand beneath the thumb, said hand plate being of arcuate configuration throughout its extent and arranged laterally from the said wrist plate, said arcuate hand plate provided for prevention of wrist extension and wrist radial deviation or pivot during usage of the training aid, a back hand plate provided within the covering device, and arranged adjacent to the arcuate hand plate, and disposed for overlying the back of the hand and the upper wrist of the user, to prevent wrist upward movement during usage of the said training aid.

9. The golf grip training aid of claim 8 wherein said back hand plate has a bend in its configuration at its approximate upper region.

10. The golf grip training aid of claim 8 wherein there are two straps connecting with the first side edge of the covering device and provided for retention of the covering device wrapped around the wrist and the hand to secure it against removal during usage.

11. The golf grip training aid of claim 10, and including buckle rings secured to the covering device and provided for connecting with the pair of straps when securing the training aid about the hand of the golfer.

12. The golf grip training aid of claim 10 and including hook and pile fastening means secured to the covering device and provided for connecting with the pair of straps when securing the training aid about the hand of the golfer.

13. The golf grip training aid of claim 8, wherein the upper edge of the hand plate integrally extends upwardly on an incline from the thumb towards the knuckles of the hand of the golfer.

* * * * *